US008109760B2

(12) United States Patent
Berkovits

(10) Patent No.: US 8,109,760 B2
(45) Date of Patent: Feb. 7, 2012

(54) IGNITOR SAFETY INTERLOCK AND TORCH

(75) Inventor: Max Berkovits, Oceanside, NY (US)

(73) Assignee: Blazer Products, Inc., Farmingdale, NY (US)

( * ) Notice: Subject to any disclaimer, the term of this patent is extended or adjusted under 35 U.S.C. 154(b) by 805 days.

(21) Appl. No.: 11/506,716

(22) Filed: Aug. 21, 2006

(65) Prior Publication Data

US 2008/0044780 A1 Feb. 21, 2008

(51) Int. Cl.
*F23D 11/36* (2006.01)

(52) U.S. Cl. ..... 431/125; 431/155

(58) Field of Classification Search ..... 431/153, 431/274, 275; 451/253
See application file for complete search history.

(56) References Cited

U.S. PATENT DOCUMENTS

| | | | | |
|---|---|---|---|---|
| 5,082,440 | A * | 1/1992 | Yamamoto | 431/143 |
| 5,460,520 | A * | 10/1995 | Lin | 431/255 |
| 5,800,155 | A * | 9/1998 | Miyanaga | 431/153 |
| 5,885,070 | A * | 3/1999 | Lin | 431/255 |
| 6,171,099 | B1 * | 1/2001 | Lin | 431/153 |
| 6,386,860 | B1 * | 5/2002 | Adams et al. | 431/153 |
| 6,533,575 | B2 * | 3/2003 | Man | 431/153 |
| 6,688,879 | B2 * | 2/2004 | Tsai | 431/153 |
| 6,796,791 | B1 * | 9/2004 | Chung | 431/153 |
| 6,988,884 | B2 * | 1/2006 | Wong | 431/153 |
| 7,147,463 | B2 * | 12/2006 | Wong | 431/153 |
| D618,059 | S * | 6/2010 | Huang | D7/416 |
| 2006/0035187 | A1 * | 2/2006 | Perez | 431/153 |
| 2006/0147858 | A1 * | 7/2006 | Chung | 431/153 |
| 2008/0124665 | A1 * | 5/2008 | Aronson et al. | 431/6 |
| 2008/0206694 | A1 * | 8/2008 | Sewalt | 431/153 |
| 2008/0213711 | A1 * | 9/2008 | Huang | 431/153 |
| 2009/0004613 | A1 * | 1/2009 | Shan | 431/153 |

* cited by examiner

*Primary Examiner* — Steven B McAllister
*Assistant Examiner* — Frances H Kamps
(74) *Attorney, Agent, or Firm* — Joanne M. Martin

(57) ABSTRACT

A torch, and ignitor or gas valve interlock located on the same part which the operator moves to activate the torch, which is overcome by the operator by providing a tangential rolling force to the interlock as the finger is seated on a downwardly actuated ignitor. The torch ignitor and gas valve interlock according to the present invention requires a skilled, compound motion easily provided by an adult and unlikely to be imposed by accidental gross motions, without diminishing or interfering with the operator's ability to easily operate the ignitor.

17 Claims, 2 Drawing Sheets

IGNITOR SAFETY INTERLOCK AND TORCH

FIELD OF THE INVENTION

The present invention relates to hand-held torches and lighters having safety interlocked ignitor, in particular torches and lighters having an ignitor interlock deactivated by the ignitor actuating finger.

BACKGROUND OF THE INVENTION

Hand-held torches and lighters are intended to be used only by one hand, the hand that holds the device. However, the added necessity of safety interlocks to prevent unwanted activation or ignition adds yet one more step, releasing the interlock, to operation of the device, in addition to holding, aiming and igniting. Often, such interlocks or safety latches require pressure or movement that is entirely separate from the movement used to ignite the flame or to hold the device, to the point of needing a separate finger or even a second hand in order to activate the torch or lighter.

Attempts to make release of the interlock proximal to the operation of the ignitor are still relatively clumsy, requiring compound motions of the actuating finger, such as sliding an element in a way that makes it harder to apply force or movement to the actual fuel valve and/or ignitor. In frustration, the typical user will simply interrupt their activity to again use both hands (if possible) to use the torch or lighter.

However, interlocks which are easier to use may also be too easy to defeat, and thus ineffective. If the lighter interlock is defeated by obvious or gross movements, then the torch or lighter may accidentally or too easily light. If the underlying application is to prevent use by children, some skill should be required, yet not overly interfere with intentional adult operation.

SUMMARY OF THE INVENTION

The torch and ignitor according to the present invention includes an ignitor and gas valve interlock located on the same part that the operator moves to activate the torch (or lighter), which is overcome by the operator by providing a tangential rolling force to the interlock as the finger is seated on a downwardly actuated ignitor. The torch ignitor and gas valve interlock according to the present invention requires a skilled, compound motion easily provided by an adult and unlikely to be imposed by accidental gross motions, without diminishing or interfering with the operator's ability to easily operate the ignitor.

BRIEF DESCRIPTION OF THE DRAWING

These and further features of the present invention will be better understood by reading the following Detailed Description together with the Drawing, wherein.

DETAILED DESCRIPTION OF EXEMPLARY EMBODIMENT

Figure 1:
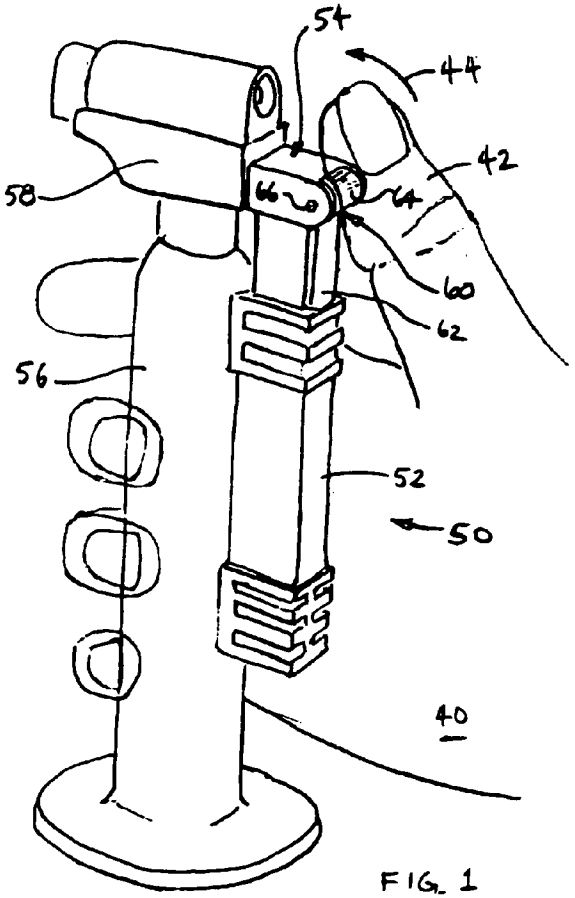
FIG. 1 is a perspective view of one embodiment of the interlock according to the present invention as provided on an exemplary hand-held torch at an initial, interlocked stage of use.

The exemplary embodiment 50 of FIG. 1 according to the present invention is typically hand 40 held and operated by the thumb 42 which comes to rest on the exemplary interlock roller 64 retained by the movable top 54. The top (or cap) 54 moves downward into the ignitor housing 52 when the interlock 60 tab 62 does not engage the top of the housing 52; however, as shown in FIG. 1, the tab 62 does engage the top 53 of the ignitor housing, serving as a 'detent' and prevents the cap 54 from moving downward from thumb 42 or other forces, thus inhibiting the ability of the ignitor (72 of FIG. 4) within the ignitor housing from operating. Additionally, the cap 54 engages a gas valve lever (89 of FIG. 4) contained within torch head 58 to provide a flow of fuel from the fuel chamber 56 as the cap is depressed (if permitted by the location of the tab 62) and prior to the activation of the ignitor.

Figure 2:
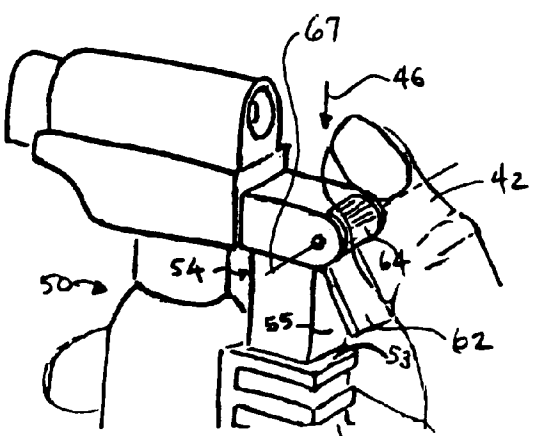
FIG. 2 is a partial perspective view of the embodiment of FIG. 1, with the interlock de-activated.

To operate the torch 50, the thumb (or other operating digit) is moved over the roller 64 to cause it to rotate about an axial pin 66 longitudinally aligned with a corresponding stop axis 67 substantially perpendicular to an axis into the ignitor housing and along a corresponding longitudinal ignitor housing axis, the pin 66 being retained in the cap 54, and rotated or rolled either by tangential motion over the roller 64 surface, by engaging the roller 64 surface and moving the thumb in an arcuate manner 44, or a combination thereof. The pin 66 and also the roller 64 (and the surface of the cap 54 receiving the thumb) is spaced from the ignitor housing 52 and its top 53 by at least the length of the tab 62 as seen in the figures. The result thereof is shown in FIG. 2, wherein the tab 62 is pivoted away from the surface 55 of the cap 54 and thus removes a stop to cap 54 movement, with the greatest separation near the top of the ignitor housing 52, in preparation for a downward movement 46 by the thumb 42, which is now possible due to the disengagement of the tab 62 from the top of the ignitor housing 52.

Figure 3:
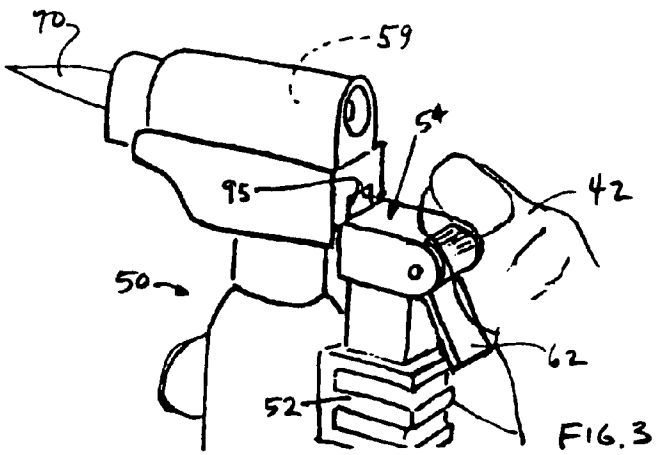
FIG. 3 is a partial perspective view of the embodiment of FIG. 1, with the torch gas valve and ignitor activated.

As shown in FIG. 3, the top 54 is now depressed into the ignitor housing 52 while maintaining the rotation of the roller 64 providing the tab 62 to overhang the ignitor housing 52, releasing a fuel (gas) flow and providing ignition (e.g. an electric spark), resulting in the desired torch 50 flame.

Figure 4:
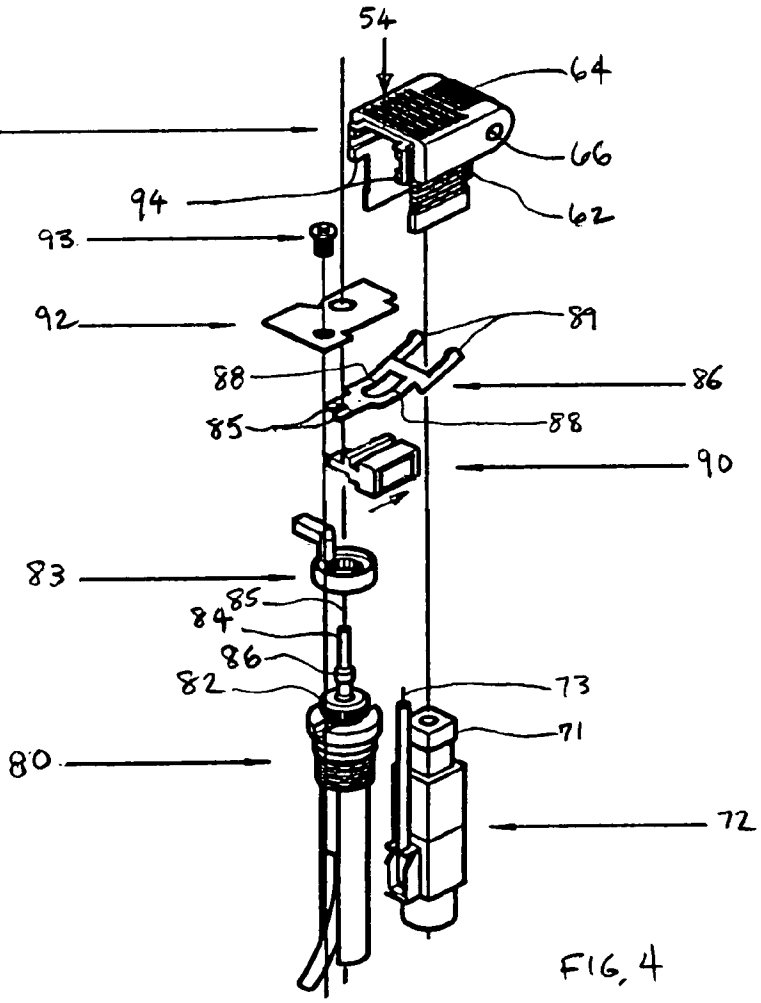
FIG. 4 is an exploded view of the disposition of typical torch gas valve and ignitor elements according to the embodiment of FIG. 1.

A more detailed view of one embodiment of the interlock according to the present invention is shown in FIG. 4. The cap 54 is connected to the ignitor 72, which in this embodiment comprises a piezoelectric spark generator which provides a high voltage pulse on wire 73 which terminates at or near the combustion region 59 within said torch head 50 where the fuel (gas in this embodiment) and any other component (e.g. air, $O_2$ etc. or other oxidation element for fuel) needed for combustion, mix, whereupon a spark is produced which ignites the mixture to produce the flame (70, FIG. 3). The movement of the cap is typically defined by the ignitor 72 movable armature 71 which in this instance is along a vertical axis, along its length. The ignitor armature 71 is typically spring-loaded to extend out from the ignitor 72 and is receptive to compression forces which move the armature 71 into the ignitor 72 as applied to the cap 54 by a digit (e.g. thumb). At a distance along its inward travel, the armature causes the ignitor to generate the spark voltage applied to wire 73.

Simultaneously with the cap 54 movement to activate the ignitor 72, the fuel (gas) valve 80 is activated to provide a fuel flow through tubular member 84 by lever 86 having first extremities 89 engaging the cap 54 (on plate 57, FIG. 4A, attached thereto) which then pivots at 88 and causes the second extremities 85 to engage and open the fuel valve 80. In the present embodiment, the fuel valve 80 is disposed within or attached to the fuel chamber 56 or other container retained therein. The exemplary embodiment of FIG. 4 provides a fuel valve that opens by pulling along the axis 85 away from the valve 80 by engaging the tubular member 84 (with an internal spring to urge the tubular member into the valve 80 away from the movement of the second extremities 85) about a radial enlargement 86 by lever 86 second extremities 85 as the cap 54 is depressed. The present embodiment further provides an adjustment of fuel flow rate when the valve 80 is open by rotating the tubular member 84 about its axis 85 with radially attached adjusting lever 83, which typically adjust an orifice opening within the flow path of the valve 80, or as otherwise known in the art. Additionally, the valve 80 may be temporarily locked in the open position by a movable wedge, e.g. slidable in one dimension in this embodiment, to engage the second extremities 85 of the lever 86 when in the position that causes the valve 80 to be open, and may be retracted to allow the valve 80 to again be closed. Moreover, the valve 80 may be stabilized by plate 92 affixed to a housing member (not shown) with screw 93 or other fixing device. Furthermore, the movement of the cap 54 is guided by ears 94 extending outward to engage edges 95 (FIG. 3) of an aperture in head 58 of the exemplary torch embodiment 50.

Figure 4A:
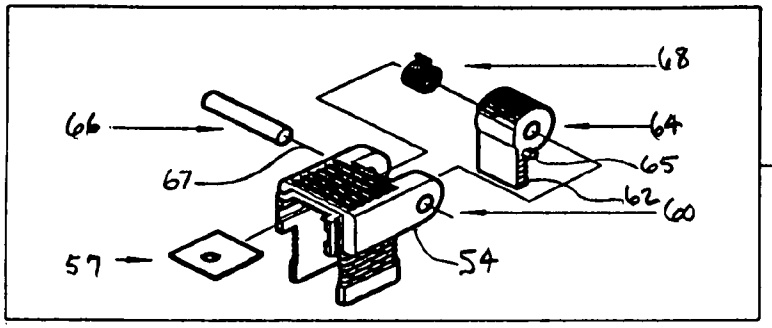
FIG. 4A is a further exploded view of the interlock according to the embodiment of FIG. 4.

A further expanded view of the interlock 60 is shown in FIG. 4A, wherein the tab 62 and roller 64 are shown as a single integrated element, which further includes a radially extending pin 65 which engages a slot (not shown) in the cap 54 to limit movement of the tab 62 away from the surface 55 (FIG. 2); movement of the tab 62 to the position where it engages the ignitor housing 52, is typically provided by merely resting against the surface 55 as urged by a spring 68 contained coaxially within the roller 64 which engages both the roller 64 and the cap 54 in the exemplary embodiment. The roller 64 is retained within the cap 54 between to appendages having apertures aligned with proper disposition of the roller 64 having spring 68 therein, adapted to receive a pin 66 therethrough. A plate 57 is attached to the cap 54 to receive the first extremities 89 of the lever 86 and provide a surface for reliable operation of the fuel valve as the cap 54 is moved downward.

Alternate embodiments envision other shapes of the roller as desired which provide the ability of the user to engage and rotate it about the pin 66 to move the tab 62 out of engagement of the housing 52. Moreover, the tab is shown extending somewhat tangentially from the roller, e.g. the tab 62 plane being offset from the axis of the pin 66, but other embodiment may include still further offset of the tab plane, or alignment thereof with the axis 67 of the pin 66 in a manner which allows the tab 62 to disengage contact with the housing ignitor 52 or any other torch 50 structure to which the tab is interposed to inhibit movement of the ignitor, the fuel valve, or both. Further modifications or substitutions by one of ordinary skill in the art are within the scope of the present invention which is not to be limited except by the claims which follow.

What is claimed is:

1. A safety torch, comprising:

a fuel chamber, a torch head, and an ignitor housing;

the fuel chamber having a longitudinal axis, comprising a source of fuel, wherein the fuel chamber is external to the ignitor housing;

the torch head comprising a combustion region receiving said fuel from said source of fuel, wherein said torch head having a lateral axis, at a non-zero axis to the longitudinal axis;

an ignitor disposed in the ignitor housing to provide a discharge of energy in said combustion region, in the presence of said fuel, said ignitor further including an actuator having an actuator member partially received within said ignitor housing and movable along a longitudinal axis of said ignitor housing, said actuator adapted to control said discharge of energy according to movement along said longitudinal ignitor housing axis and including an end surface intersecting, and substantially perpendicular to said longitudinal ignitor housing axis proximal to an axial terminus of said ignitor housing most proximal to said combustion region and adapted to receive an actuating force directed substantially along said longitudinal ignitor housing axis away from said combustion region to result in said discharge of energy, a detent disposed in fixed, proximal and external association to said ignitor housing axial terminus, and an actuator stop rotatable about a stop axis perpendicular from said longitudinal ignitor housing axis, said actuator stop comprising a surface having a portion proximal to said end surface, and a first external tab member having a length and being external to said ignitor housing extending away from said stop axis to engage said detent and prevent movement along said longitudinal ignitor housing when so engaged, said end surface being spaced from said ignitor housing proximal end at least said tab member length, and being rotatable about said stop axis in a first direction away from said detent upon application of a force tangential to said actuator surface and at least partially along said longitudinal axis of said ignitor housing and being rotationally limited by a rotational limiting element engaging said actuator stop and said actuator member, permitting movement of said first external tab such that it extends outwardly from the ignitor housing, is spaced apart from said housing and completely disengage said tab, and movement of said actuator along said longitudinal axis of said ignitor housing, wherein said discharge of energy is provided.

2. The safety torch of claim 1, wherein said stop axis is offset from said longitudinal axis of said ignitor housing.

3. The safety torch of claim 1, wherein said actuator stop comprises a central member rotatable about said stop axis, and wherein said actuator stop first member comprises a member connected to said central member and extends one of tangentially and radially away from said stop axis.

4. The safety torch of claim 1, wherein said actuator member includes a support to receive and move said actuator stop along said longitudinal axis of said ignitor housing together with said actuator member.

5. The safety torch of claim 4, wherein said actuator stop is supported through said stop axis, and said actuator member support includes a stop axis support protruding therefrom, to support said actuator stop as it rotates about said stop axis and as it moves along said longitudinal axis of said ignitor housing.

6. A safety interlocked ignitor, comprising:

an ignitor housing body elongated in a longitudinal dimension;

a fuel chamber comprising a source of fuel having a longitudinal axis;

an actuator movable along a longitudinal axis of said ignitor housing body to selectively provide discharge of energy according to movement along said longitudinal ignitor housing axis and including a surface proximal to an ignitor housing body longitudinal end disposed to receive an actuation force directed parallel to said fuel chamber longitudinal axis, further including an energy source providing said discharge of energy in response movement of said actuator along said longitudinal ignitor housing axis;

a detent disposed in fixed relation to said ignitor housing body; and an actuator stop disposed proximal to said actuator surface and rotatable about an actuator stop axis perpendicular from said longitudinal axis of said ignitor housing being rotationally limited by a rotation limiting element engaging said actuator stop and said actuator surface, said actuator stop comprising a surface adjacent to said actuator surface, and a first external tab member having a length and extending away from said stop axis to engage said detent and prevent movement along said longitudinal axis of said ignitor housing when so engaged, said actuator surface being spaced from said ignitor housing body and to extend beyond said ignitor housing body by at least said tab member length, and said actuator stop surface being disposed relative to said actuator surface to receive a tangential force on said actuator stop surface to urge actuator stop rotation in a first direction about said stop axis to be spaced from and completely disengage from said detent while said actuator surface receives said actuation force permitting movement of said first external tab such that it extends outwardly and is spaced from the ignitor housing, and to induce movement of said actuator along said longitudinal axis of said ignitor housing in the same direction of at least a component of said tangential force to provide said discharge of said flow of energy; and a torch head comprising a combustion regions receiving said fuel from said source of fuel, wherein the surface proximal to an ignitor housing body engages a gas valve lever contained within said torch head to provide a flow of fuel from the fuel chamber as the surface is depressed.

7. The safety torch of claim 6, wherein said stop axis is offset from said longitudinal axis of said ignitor housing.

8. The safety torch of claim 6, wherein said actuator stop comprises a central member rotatable about said stop axis, and wherein said actuator stop first member comprises a member connected to said central member and extends one of tangentially and radially away from said stop axis.

9. The safety torch of claim 6, wherein said actuator member includes a support to receive and move said actuator stop along said longitudinal axis of said ignitor housing together with said actuator member.

10. The safety torch of claim 9, wherein said actuator stop is supported through said stop axis, and said actuator member support includes a stop axis support to support said actuator stop as it rotates about said stop axis and as it moves along said longitudinal axis of said ignitor housing.

11. The safety torch of claim 6, wherein said energy source comprises one of a piezo electric element and a flint element.

12. The safety torch of claim 6, wherein said detent comprises one of a recess and a shoulder.

13. A method for safely operating a torch, comprising the steps of:

providing a fuel chamber and a fuel valve, an ignitor housing and an ignitor actuator, and a torch head, wherein the fuel chamber and the ignitor housing are elongated in a parallel direction and are located external to each other;

inhibiting the motion of at least one of a fuel valve and an ignitor actuator along a first axis by interposing an external tab actuator stop member, the external stop member extending away from said first axis, externally engaging a detent and inhibiting movement along said first axis when so engaged;

rolling said external tab actuator stop member along a second axis perpendicular to said first axis in a first rotational direction with a tangential force to a release position to release said external tab actuator stop from said detent and said actuator housing and be space apart therefrom when so released, whereby releasing said actuator to move along said first axis, and wherein said external tab actuator stop member have a length, said first axis being spaced from said ignitor housing by at least the length of said tab stop member;

rotationally limiting said tab actuator stop member rotation about said second axis with a limit element engaging said tab actuator stop member and said ignitor actuator and moving said at least one of said fuel valve and said actuator after being released while maintaining said release position, along said first axis to produce a corresponding flow of fuel and flow of energy.

14. The method of claim 13, wherein said step of rolling comprises the step of rolling said actuator stop with a selected operator digit moved in one of a direction tangential to said actuator stop and in an arcuate direction, and subsequently moving said actuator stop in a direction along said first axis.

15. The method of claim 14, wherein said step of moving said actuator comprises the step of moving said actuator with said selected operator digit.

16. The method of claim 13, wherein the step of rolling said actuator stop comprises the step of rolling said actuator stop along a second axis perpendicular to and offset from said first axis to release said actuator to move along said first axis.

17. The method of claim 13, wherein said step of inhibiting and said step of moving a fuel valve respectively comprises the steps of inhibiting and moving a gas valve interlock.

* * * * *